United States Patent [19]

Björkestam et al.

[11] Patent Number: 4,776,755

[45] Date of Patent: Oct. 11, 1988

[54] SHROUDED PROPELLER

[75] Inventors: Hans Björkestam, Helsinki; Sauli Immonen, Savonlinna; Heikki Tulkki; Harry Lindroos, both of Helsinki, all of Finland

[73] Assignee: Wärtsilä Meriteollisuus Oy, Helsinki, Finland

[21] Appl. No.: 30,871

[22] Filed: Mar. 26, 1987

[30] Foreign Application Priority Data

Mar. 27, 1986 [FI] Finland ..... 861370
Mar. 27, 1986 [FI] Finland ..... 861371

[51] Int. Cl.[4] ..... B63H 1/28

[52] U.S. Cl. ..... 415/121 G; 415/213 C; 416/189; 416/247 A

[58] Field of Search ..... 416/189 R, 181, 146 B, 416/247 A; 415/121 G, 213 C; 440/67, 71

[56] References Cited

U.S. PATENT DOCUMENTS

| | | | |
|---|---|---|---|
| 2,723,641 | 11/1955 | Taylor | 416/247 A |
| 3,499,412 | 3/1970 | Anthes et al. | 416/189 R X |
| 3,508,517 | 4/1970 | Hannan | 440/67 |
| 3,519,367 | 7/1970 | Soulez-Lariviere | 416/189 R X |
| 3,677,660 | 7/1972 | Taniguchi et al. | 416/189 R |
| 3,738,307 | 6/1973 | Jacobsen et al. | 440/67 |
| 4,288,223 | 9/1981 | González et al. | 416/189 R X |
| 4,427,393 | 1/1984 | May | 416/247 A X |
| 4,613,279 | 9/1986 | Corren et al. | 415/121 G X |

FOREIGN PATENT DOCUMENTS

| | | | |
|---|---|---|---|
| 2606448 | 8/1977 | Fed. Rep. of Germany | 416/189 R |
| 388958 | 11/1983 | U.S.S.R. | 440/71 |
| 1175796 | 8/1985 | U.S.S.R. | 440/67 |
| 460765 | 2/1937 | United Kingdom | 416/189 R |
| 1409346 | 10/1975 | United Kingdom | 440/71 |

*Primary Examiner*—Everette A. Powell, Jr.
*Attorney, Agent, or Firm*—Dellett, Smith-Hill and Bedell

[57] ABSTRACT

A shrouded propeller for operation in ice-filled waters, which arrangement comprises a propeller and a nozzle encirculating the propeller, which propeller arrangement comprises an ice crusher annulus. The propeller arrangement is provided by at least one first flow path for the water flow entering the nozzle, which first path is directed via the interspace between said annulus and the actual nozzle. The first path is further directed to and through the nozzle interior. The arrangement is provided by a flow path for the water main flow through the central portion bordered by said annulus. If the central flow path is obstructed by ice chunks, said first path is available for the water flow inside the nozzle.

10 Claims, 4 Drawing Sheets

SHROUDED PROPELLER

Figure 2:
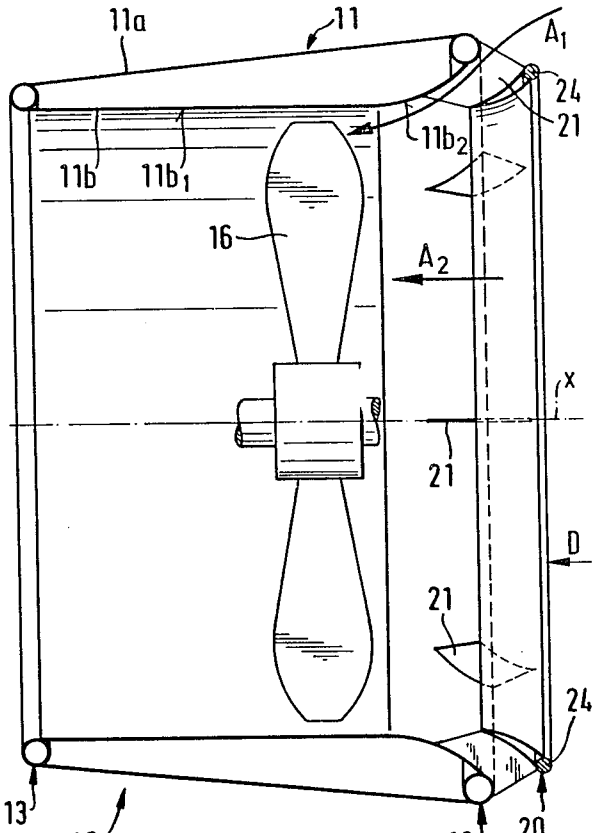

The invention relates to a shrouded propeller intended for operation in ice-filled waters.

Shrouded propellers, involving fitting a ring nozzle around a propeller, have commonly been used for vessels in order to improve the thrust. However, a considerable drawback of such shrouded propellers is their tendency to get blocked in ice conditions, when big ice chunks hit the nozzle, stop in front of it and prevent the water flow to the propeller. Hereby the thrust of the propeller is decreased and big strains are acting on the screw blades, the axle and the bearings.

Previous different arrangements exist in connection with shrouded propellers, by means of which it has been tried to prevent ice from entering the nozzle. For example, grid constructions have been applied in front of the propeller. Such propeller guards prevent big chunks from entering the nozzle together with the water flow. A drawback is, however, that the grids are rather close each other in order to achieve appropriate operation, whereby the flow resistance is increased and the efficiency of the propulsion is impaired. The grid constructions also have a tendency to get blocked by ice sludge.

Protective fins have been arranded in front of the shrouded propeller so, that the fins are rigidly attached at their one end to the hull of the vessel and, at their opposite end, to the nozzle. A drawback is hereby the big flow resistance of the fins. When the fins are oriented to form a big angle relative to the direction of the water flow, ice chunks have a tendency to get jammed and block the shrouded propeller.

Such an arrangement is also known, in which the inner surface of the nozzle has a configuration which enables the edges of the screw blades to cursh ice chunks between said edge and the nozzle. The uneven inner surface is hereby formed to prevent ice chunks from becoming wedged inside the nozzle, and they are also acting as sharp-edged crushing means for the chunks. Another arrangement comprises a shrouded propeller in which the nozzle is formed so that the screw blades at some positions extend beyond the front edge of the nozzle. By means of this arrangement ice chunks are prevented from heaping up against the front edge of the nozzle. A drawback is hereby that the arrangement doesn't prevent ice chunks from entering the nozzle, but such chunks that have got into the nozzle must be crushed by the propeller, whereby the efficiency of the propeller is impaired.

The object of the invention is to create such a shrouded propeller, by means of which the quoted drawbacks of prior art are avoided. The object is particularly to avoid drawbacks occuring when big ice chunks block the nozzle up. A further object is to create a ducted propeller system, which maintains a big thrust also in difficult ice conditions, and which decreases the strains of ice chunks on screw blades, axle and bearings. The object is further to create a shrouded propeller system, which is provided by means to allow a water flow to enter the nozzle also in case ice chunks are blocking the main opening of the nozzle.

According to the invention, the nozzle of a shrouded propeller is provided with protecting means that extend in the water flow to the front of the nozzle so that said means either crush ice chunks driving onto them or place said chunks in a position which still allows a free flow of water between the nozzle and the ice chunks to the propeller.

In a preferred embodiment, said protective means comprise a number of rigid ice crushing elements attached to the front periphery of the nozzle and extending to the front of this. The protective elements are preferably formed as a plate, with an ice cutting or crushing front edge. The form of the elements as well as their attachment positions are chosen to cause as small a flow resistance as possible. The attachement is preferably accomplished by means of welding. The length of these elements is just a fractional part of the overall length of the nozzle. The elements are well suited for modifying of conventional shrouded propellers, and both the material and labour costs are hereby quite moderate.

Figure 1:
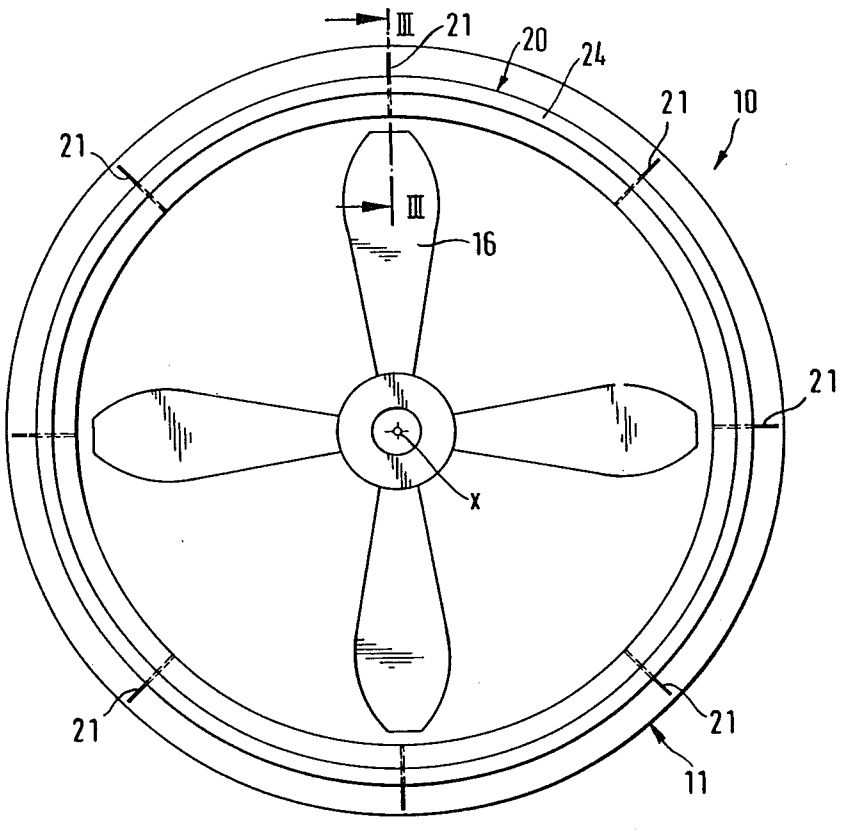
Figure 3:
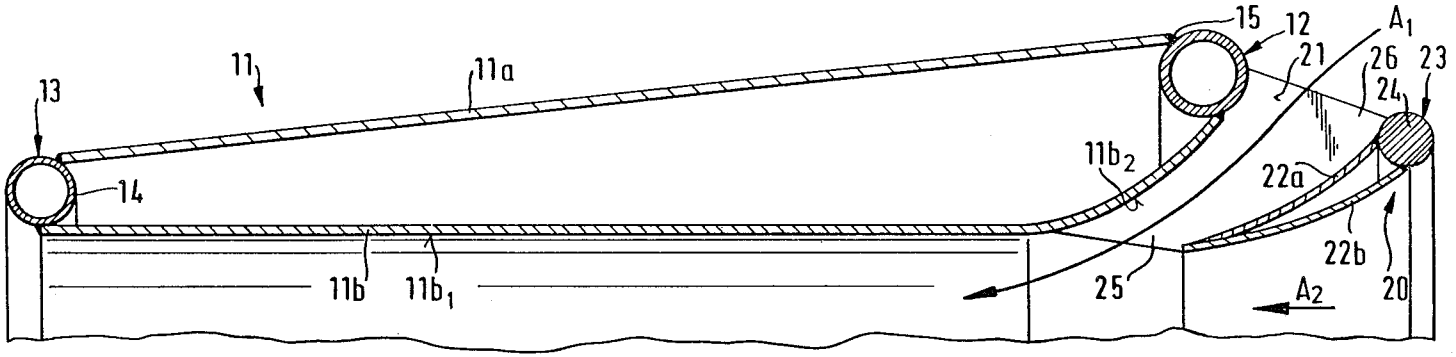
Figure 4:
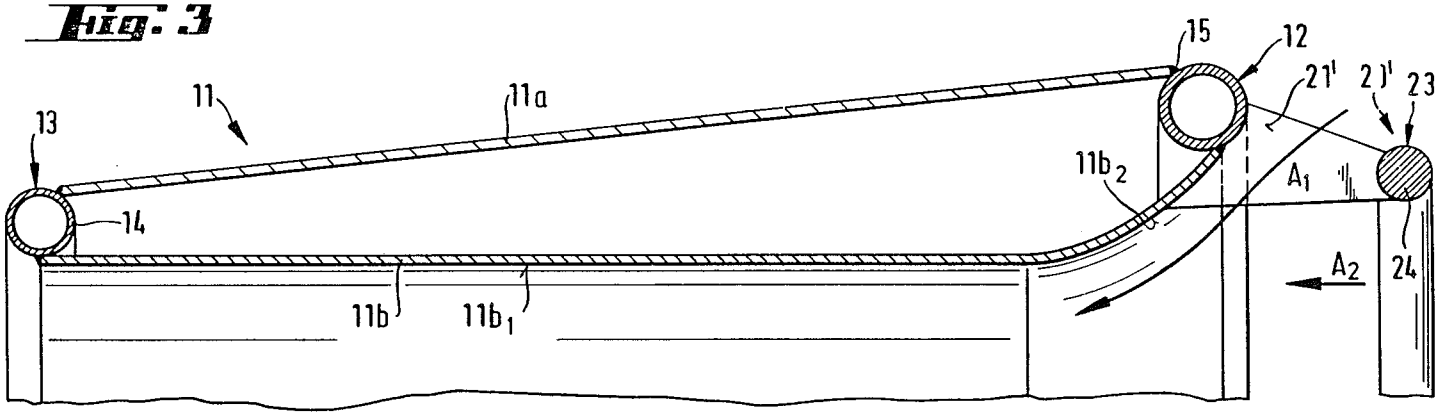
Figure 5:
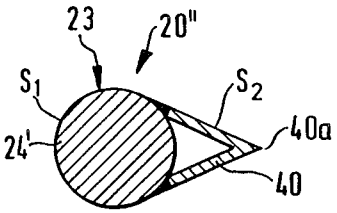
Figure 7:
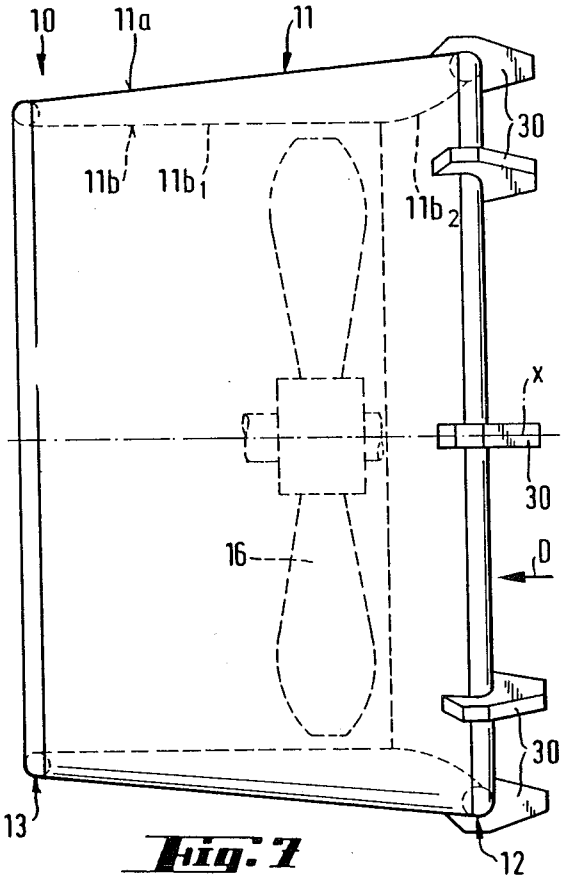
Figure 6:
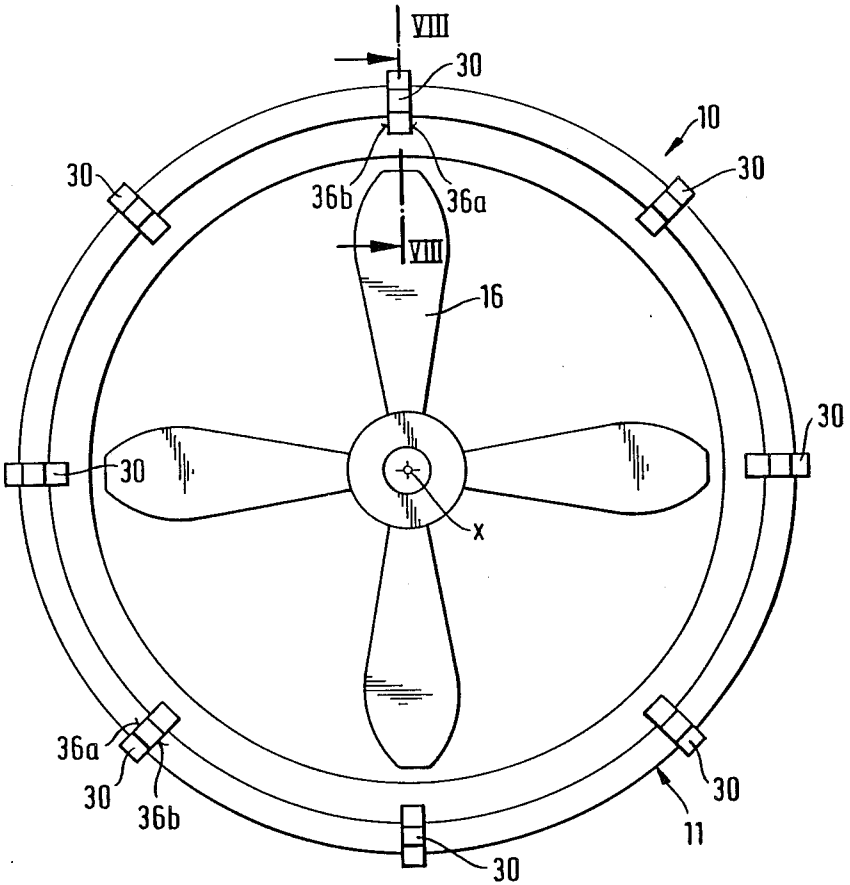
Figure 8:
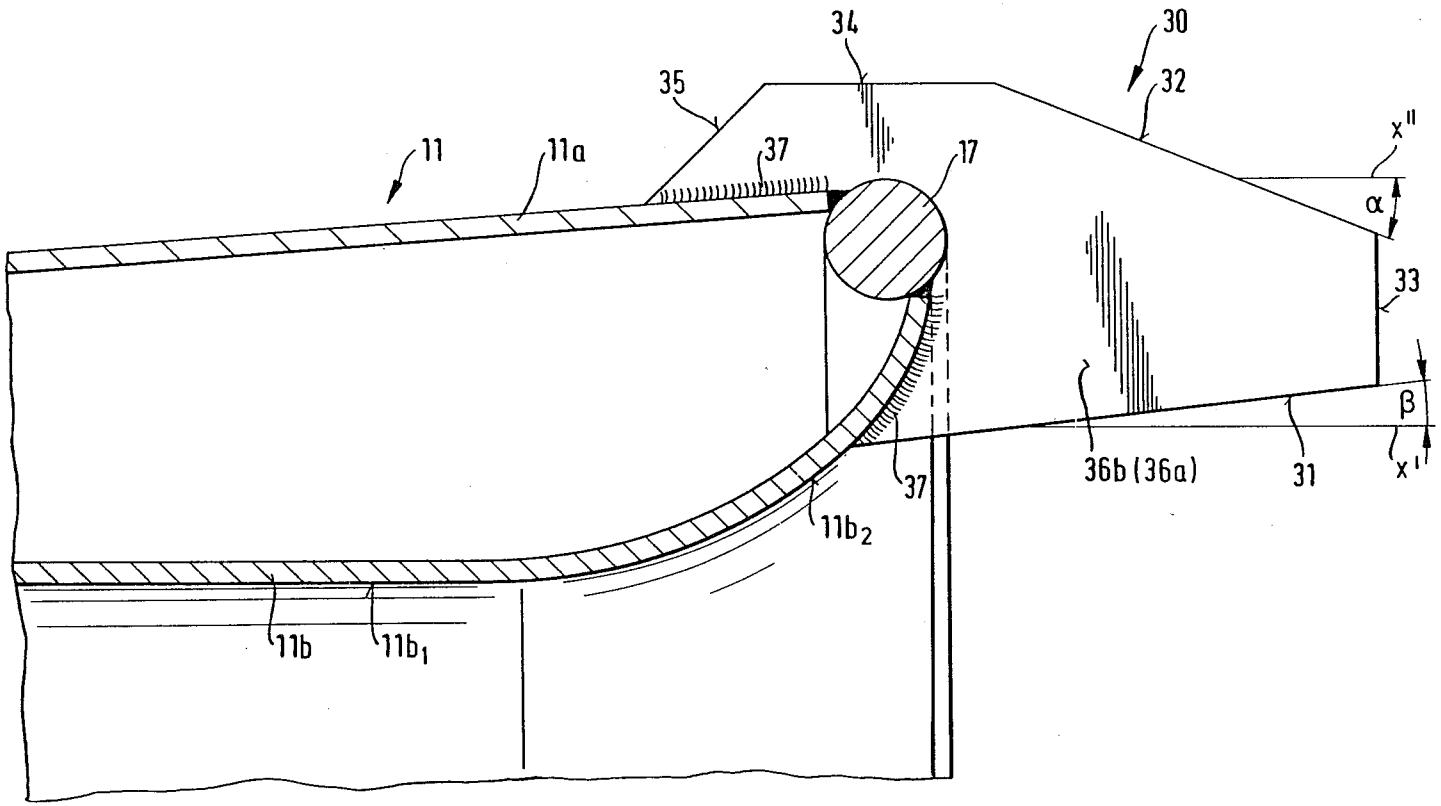

The invention is described in the following in detail with reference to the attached drawing in which FIG. 1 presents a front view of a first embodiment of the invention, FIG. 2 is a sectioned side view of the embodiment of FIG. 1, the propeller being shown schematically only, FIG. 3 is a section of the shrouded propeller, the section being taken along the line III—III of FIG. 1, FIG. 4 presents another embodiment of the invention in a section corresponding to FIG. 3, FIG. 5 discloses a favourable profile shape of the ice crusher annulus, FIGS. 6–8 illustrate a further embodiment of the invention.

FIG. 1 discloses a shrouded propeller 10 according to the invention. A propeller 16 located inside the nozzle 11 is schematically presented. Power appliances and the power intake means of propeller 16 are not shown. The rotational drive of propeller 16 can be realized by transmitting the rotational effect either directly through the nozzle or directly from the power appliance via a drive shaft, which is parallel with the rotation shaft of propeller 16. Nozzle 11 surrounding propeller 16 comprises an outer surface 11*a* and an inner surface 11*b*. Inner surface 11*b* has a hydrodynamically favourable shape and surface 11*b* comprises a curved front edge $11b_2$, which is essentially directly connected to an inner midportion $11b_1$. The nozzle 11 can be supported by means of support members, which can be so arranged that the nozzle is turnable when being supported by said members, which hereby act as journalling members. Favourably said members comprise an upper support and a lower support.

Shrouded propeller 10 comprises an ice crusher annulus 20 arranged in the vicinity of front edge 12 of nozzle 10. Said annulus 20 is most favourably located at the very front edge 12 of nozzle 11, so that the water flow entering nozzle 11 passes between ice crusher annulus 20 and nozzle 11. Arrow $A_1$ corresponds said flow arrangement. The water flow further passes the midportion of the nozzle, which is bordered by ice crusher annulus 20; arrow $A_2$ presents the flow through said nozzle portion.

Annulus 20 is attached by means of separate attachment ribs 21 at nozzle 11. Ribs 21 are preferably plates, which are arranged between ice crusher annulus 20 and nozzle 11 so that their surfaces are parallel to the flow direction $A_1$. Said arrangement is favourable if the intention is to keep the flow resistance at its minimum. The embodiment of nozzle 11 and ice crusher annulus 20 shown in FIGS. 1 and 2 is shown in section and more in detail in FIG. 3. Front edge 23 of ice crusher annulus 20 is favourably ice-cutting and narrow shaped.

Front edge 23 is favourably formed from a small-diameter round bar 24. The small diameter of front edge 23 assists the ice crushing. Front edge 23 can also be sharp or wedge-shaped. Annulus 20 is arranged to be located in front of front edge 12 of nozzle 11. Ice crusher annulus 20 is favourably arranged to be located in the vicinity of front edge 12, so that the inlet opening 26 of the flow path 25, which is located between annulus 20 and nozzle 11, is located in a skewed orientation relative to central axis x or the rotation shaft x of the propeller. Said arrangement aids the nozzle to stay unclogged even in severe ice conditions. Said arrangement prevents ice chunks from jamming between front edge 23 of ice crusher annulus 20 and round bar 15 located at front edge 12 of nozzle 11. The flow path 25 will remain free of ice. If, however ice should obstruct the path of central flow $A_2$, flow $A_1$ still has an ice-free path in to nozzle 11 via inlet opening 26.

Ice crusher annulus (FIG. 3) comprises plate portions 22*a*, 22*b* connected to round bar 24. Said plate portions are favourably curved, hereby forming a continuous and smooth flow path inside the nozzle. Plate portions 22*a*, 22*b* are connected at their one end at round bar 24 and mutually at their second end. Plate 22*b* facing nozzle 11 is attached by a rib 21 at nozzle 11 and at the curved inner surface $11b_2$ of nozzle 11. Ice crusher annulus 20 is in this manner attached to nozzle 11 through said rib 21. The general cross section of ice crusher annulus 20 is circular, as shown in FIGS. 1, 2.

Another embodiment comprises an annulus 20 and a nozzle 11, which are cast to form a single entity.

Modifications of the described embodiments or several ice crusher annulus units 20 can also be arranged within the invention. Instead of being located at the front edge 12, ice crusher annulus 20 can be located at the trailing edge 13. Another possibility is to arrange a first annulus at the front edge and a second annulus at the trailing edge 13. These further embodiments and modifications correspond the earlier quoted members and they operate in a mainly similar fashion.

FIG. 4 shows a second favourable embodiment. Annulus 20' is adapted to locate in front of the actual nozzle. Annulus 20' is formed from a rather small-diameter round rod and is attached by ribs 21' at the front edge 12 of the nozzle. Annulus 20' can as well be formed so that the flow paths, which are located between the annulus and the shroud, have their inlet openings perpendicular relative to the central flow ($A_2$) entering the shroud.

In a third embodiment (not shown) annulus 20 and the main nozzle form a single entity, whereby flow paths for flows ($A_1$) are formed by perforating the main nozzle housing. The openings are favourably located on the periphery of the main nozzle and favourably located at equal intervals. The front and/or the trailing edge form in this embodiment the annulus 20. Said edge is separated from the actual central nozzle body (11) by means of said openings or corresponding flow path members.

FIG. 5 shows a favourable cross section shape of an ice crusher annulus 20''. The peripheral cross section comprises a curved portion $S_1$ and a sharp and ice crushing edge portion $S_2$, which is located at the opposite side relative to curved portion $S_1$. A triangular profile member 40 is hereby favourably connected to the round bar 24'. Member 40 comprises a sharp front edge 40*a*. Annulus 20'' is attached by ribs or the like (not shown) at the front and/or the trailing edge of the nozzle, which edges are hydrodynamically optimally shaped.

FIGS. 6–8 show a nozzle 11 which is provided with ice spikes 30 extending axially beyond front edge 12 or trailing edge 13 (not shown) of nozzle 11. Spikes 30 are attached by welding at outer surface 11*a* and curved inner surface portion $11b_2$ of nozzle 11 in the vicinity of the extreme nozzle edge 12 or 13. Outer surface 11*a* is generally a smooth and continuous conelike surface. Inner surface 11*b* comprises a conelike or cylinderlike nozzle surface portion $11b_1$ and said curved portion $11b_2$. Propeller 16 is located in the region between edges 12, 13 as shown.

The embodiment shown includes eight spikes 30 located at about 45° peripheral intervals. Spike 30 is formed from a flat plate, which comprises two parallel side surface 36*a* and 36*b*, a front surface 33, an inner surface 31 and an outer surface portion 32,34,35. Inner surface 31 is set at an angle $\beta$ relative to direction x' which is parallel with the rotation shaft x of propeller 16. Angle $\beta$ is favourably between 10°–60°. The front part 32 of outer 32,34,35 is set at an angle $\alpha$, which is favourably between 20°–60° relative to a direction x'' parallel with said shaft x. Front surface 33 acts as ice crushing edge, which is mainly perpendicular relative to the average water flow direction entering and going out from nozzle 11. The orientation of surfaces 31 and 32 makes possible to increase the spike dimensions, whereby the spike is firm enough. Reference numeral 37 refers to a welding seam and numeral 17 to a reinforcing round bar member in the front portion of nozzle 11.

A modification of the illustrated embodiment is possible through a casting process, in which the nozzle 11 and the spikes 30 are manufactured as a single entity. Spikes 30 can be produced through forging, too.

If spike 30 hits an ice chunk, front edge 33 breaks the ice whereby the ice chunk disintegrates. If the ice chunk or floe is so big or hard that it does not disintegrate, ice spike 30 or spikes 30 keep said chunk out of contact from front edge 12 of nozzle, whereby a free slot is available for water flow.

Spikes 30 are adjusted in conjunction with extreme edge 12,13 so that surfaces 36*a*,36*b* are perpendicular against a cross section plane, which is perpendicular against the direction parallel with shaft x. Spikes 30 produced from plate portions generate hereby the most minor flow resistance. Another possibility is to set the platelike spikes 30 in an inclined orientation relative to the water flow D entering nozzle 11. The object hereby is to increase the efficiency of propeller 16, which is realized through turbulence motions in the water flow which approaches propeller 16. The rotation of propeller 16 and the turbulence rotation directions are opposite.

It is also possible to have spikes 30 at trailing edge 13 or at both extreme edges 12,13. The spikes 30 at trailing edge 13 break ice chunks when operating propeller 16 in the reverse direction or when an ice field is moving against trailing edge 13 of nozzle 11. Spikes 30 visualized in FIGS. 6–8 can also be wedge-shaped including a sharp front peak instead of edge 33; said peak can be a tooth-like member.

The invention is not limited to the embodiments disclosed, but several modifications thereof are feasible within the scope of the attached claims.

We claim:

1. A shrouded propeller arrangement for operation in ice-filled waters, which comprise:

a propeller having a central axis, a nozzle which has a central axis and is mounted so that its central axis substantially coincides with the central axis of the propeller, the nozzle having first and second opposite ends and being substantially rotationally symmetrical about its central axis, and an ice breaker annulus mounted substantially coaxialy with the nozzle at said first end thereof and spaced therefrom, said ice breaker annulus defining a substantially unobstructed aperture and extending axially beyond said said first end of the nozzle, the radius of the aperture defined by the ice breaker annulus not being substantially less than the radius of the inner periphery of the nozzle, whereby a main flow path for water entering the nozzle passes through the aperture, and the radius of the outer periphery of the ice breaker annulus being less than the radius of the outer periphery of the nozzle at said first and thereof, whereby a secondary flow path for water entering the nozzle passes by way of the space between the ice breaker annulus and the nozzle, so that in the event that the main flow path is obstructed, the secondary path is available for water flow into the nozzle, the ice breaker annulus acting on ice chunks or floes moving against it so that said chunks or floes are crushed or held at a distance from said nozzle, whereby a free water flow path through said nozzle is maintained.

2. A propeller arrangement according to claim 1, wherein the nozzle has a front end and a rear end and the ice breaker annulus is located beyond the front end of the nozzle in the direction from the rear end to the front end thereof.

3. A propeller arrangement according to claim 1, wherein the ice breaker annulus is so disposed relative to the nozzle that the secondary flow path is inclined relative to the central axes of the propeller and the nozzle.

4. A propeller arrangement according to claim 1, wherein the ice breaker annulus has a leading edge which is sharp for crushing ice.

5. A propeller arrangement according to claim 1, wherein the ice breaker annulus comprises a bar of circular cross-section and a triangular profile member connected to the bar.

6. A propeller arrangement according to claim 1, wherein the ice breaker annulus, when viewed in section, has a curved trailing edge and a sharp leading edge.

7. A propeller arrangement according to claim 1, wherein the ice breaker annulus comprises a bar of circular cross-section, at least one annular plate member connected to the bar and extending at least partially towards the nozzle, and ribs which connect the plate member to the nozzle.

8. A propeller arrangement according to claim 7, wherein the ice breaker annulus comprises first and second annular plate members each having a leading edge and a trailing edge, the leading edges of the plate members being connected to the bar and the trailing edges of the plate members being connected together.

9. A propeller arrangement according to claim 1, wherein the ice breaker annulus comprises a round bar member and ribs which attach the bar member to the nozzle.

10. A propeller arrangement according to claim 1, wherein the nozzle is formed with openings which allow water to enter the nozzle if the main flow path is obstructed.

* * * * *